US005800975A

United States Patent [19]

Suzuki

[11] Patent Number: 5,800,975

[45] Date of Patent: Sep. 1, 1998

[54] SILVER HALIDE PHOTOGRAPHIC LIGHT SENSITIVE MATERIAL

[75] Inventor: Tetsuya Suzuki, Hino, Japan

[73] Assignee: Konica Corporation, Tokyo, Japan

[21] Appl. No.: 570,488

[22] Filed: Dec. 11, 1995

[30] Foreign Application Priority Data

Dec. 14, 1994 [JP] Japan ..... 6-310762

[51] Int. Cl.[6] ..... G03C 1/09; G03C 1/035

[52] U.S. Cl. ..... 430/567; 430/569; 430/600; 430/603

[58] Field of Search ..... 430/567, 569, 430/600, 603

[56] References Cited

U.S. PATENT DOCUMENTS

| | | | |
|---|---|---|---|
| 1,574,944 | 3/1926 | Sheppard | 430/603 |
| 3,656,955 | 4/1972 | Ushimaru et al. | 430/600 |
| 4,063,951 | 12/1977 | Bogg | 430/567 |
| 4,386,156 | 5/1983 | Mignot | 430/567 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 5,178,997 | 1/1993 | Maskasky | 430/567 |
| 5,252,452 | 10/1993 | Chang et al. | 430/567 |
| 5,273,871 | 12/1993 | Takada et al. | 430/567 |
| 5,275,930 | 1/1994 | Maskasky | 430/567 |
| 5,314,798 | 5/1994 | Brust et al. | 430/567 |
| 5,320,938 | 6/1994 | House et al. | 430/567 |
| 5,389,509 | 2/1995 | Maskasky | 430/567 |
| 5,496,694 | 3/1996 | Kikuchi et al. | 430/569 |
| 5,529,895 | 6/1996 | Ihama | 430/569 |

FOREIGN PATENT DOCUMENTS

| | | | |
|---|---|---|---|
| 0 480 294 A1 | 4/1992 | European Pat. Off. | G03C 1/015 |

*Primary Examiner*—Mark F. Huff

*Attorney, Agent, or Firm*—Finnegan, Henderson, Farabow, Garrett & Dunner, L.L.P.

[57] ABSTRACT

A silver halide black and white photographic light sensitive material comprising a support having thereon a silver halide emulsion layer containing {100} tabular silver halide grains, which have an average silver chloride content of 50 mol % or more and have been selenium-sensitized in the presence of a purine compound; said silver halide grains further containing silver iodide and a variation coefficient of a silver iodide content of the grains being 30% or less.

8 Claims, No Drawings

SILVER HALIDE PHOTOGRAPHIC LIGHT SENSITIVE MATERIAL

FIELD OF THE INVENTION

The present invention relates to a silver halide photographic light sensitive material, particularly relates to a silver halide photographic light sensitive material high in sensitivity, excellent in rapid processability and improved in abrasion mark.

BACKGROUND OF THE INVENTION

It has been known that the use of tabular silver halide emulsion grains in a silver halide photographic light sensitive material (hereinafter, abbreviated simply as a photographic material) led to improvements in spectral sesitization, covering power, sharpness and graininess. On the other hand, as well known, the tabular silver halide grains have a defect in pressure resistance due to the form so that the grains are susceptible to abrasion mark and kink fogging. Recently, there have been employed tabular grains having twin planes parallel to each other. The tabular grains having the twin planes have major faces comprising {100} faces, having a hexagon or trianle form based on the lattice structure of the {100} face.

There have been desired tabular grains having major faces comprised of {100} faces based on the fact that, in the case when a lot of sensitizing dyes are adsorbed to silver halide grains, grains having major faces comprised of {100} faces were superior in spectral sensitization. U.S. Pat. No. 4,063,951 discloses a preparation methof of a silver halide emulsion comprising tabular grains having two parallel major faces comprised of {100} faces and an aspect ration of 1.5 to 7. The {100} major faces are in the form of quadrilateral, based on the lattice structure thereof.

With regard to rapid processing of a photographic material, on the other hand, processing by an automatic processor is rapidly advancing along with an increase in the need thereof in the market. It has been generally known in the photographic art that a high chloride silver halide emulsion is preferable for rapid-processing of a photographic material. However, a silver chloride emulsion is low in sensitivity and susceptible to be fogged, so that it has been difficult to employ the emulsion in a photographic material for medical use which required high sensitivity. U.S. Pat. No. 5,275,930 disclosed a technique regarding the epitaxial growth on a tabular grain having a silver chloride content of 50 mol % or more, an aspect ratio of 8 or more and {100} major faces. Further, U.S. Pat. No. 5,314,798 disclosed a technique regading silver iodobromide grains having a silver chloride content of 50 mol % or more, an aspect ratio of 2 or more and {100} major faces. However, when these grains were employed in a photographic material, it was found to be low in sensitivity and susceptible to abrasion mark in handling thereof so that further improved technique is required.

SUMMARY OF THE INVENTION

Accordingly, an object of the present invention is to provide a silver halide photographic light sensitive material high in sensitivity, superior in rapid processability and improved in abrasion marks; and a sensitizing method of a silver halide emulsion.

The above object of the present inventiion can be accomplished by a silver halide photographic light sensitive material comprising silver halide emulsion layer, wherein said silver halide emulsion layer contains silver halide grains which have been selenium-sensitized and contain 50 mol % or more silver chloride, and a variation coefficient with respect to silver iodide contained in each of said grains is 30% or less.

DETAILED EXPLANATION OF THE INVENTION

A silver halide emulsion used in the invention may comprise 50 mol % or more chloride-containing regular crystal grains which have isotropically growned, such as cubic, octahedral or tetradechedral crystals, polyhedral crystals such as sphere crystals, twinned crystal grains having a plane defect such as twin plane, or a mixture or composite thereof. In the invention, are preferable tabular silver halide grains having two parallel major faces comprised of {100} faces.

A silver halide emulsion used in a silver halide photographic light sensitive material of the invention can be prepared in accordance with methods known in the photographic art, such as a method described in Research Disclosure (RD) No.17643 (December, 1978), pages 22–23, "Emulsion Preparation and Types" and a method descrinbed in RD No. 18716 (November, 1979), page 648.

Further, the emulsion used in a silver halide photographic light sensitive material of the invention can be prepared in accodance with methods as described in T. H. James, "The Theory of the Photographic process" 4th ed. Macmillan (1977) pages 3–104, G. F. Duffin, "Photographic Emulsion Chemistry", Focal Press (1966), P. Glafkides "Chimie et Physique Photographique" Paul Montel (1967), V. L. Zelikman et al. "Making and coating Photographic Emulsion" Focal Press (1964).

Thus, the emulsion can be prepared using a solution condition such as acidic method, ammoniacal method or neutral method; mixing condition such as normal precipitation, reversed precipitation, double jet method or controlled double jet method; grain-forming condition such as a conversion method or core/shell method; or a combination thereof.

The tabular grains advantageously leads to enhancement of spectral sensitization and improvements in graininess and sharpness of the image, as described in British patent No. 2,112,157, U.S. Pat. Nos. 4,439,520, 4,433,048, 4,414,310 and 4,434,226.

The tabular silver halide grains employed in the invention have major faces of {100} faces and an average grain size of 0.3 to 3.0 μm, preferably, 0.5 to 1.5 μm. In the invention, the average grain size of the tabular silver halide grains refers to an average value of edge lengths of the major faces of the grains. The term, "major faces" refers to two parallel crystal faces, each of which is substantially larger than any other single crystal face of the grain.

The tabular silver halide grains used in the invention have an average value of a ratio of grain edge length to thickness (hereinafter, denoted as an aspect ratio) of 2.0 or more, preferably, 2.0 to 20.0, more preferably, 2.2 to 8.0. To determine the aspect ratio, at least 100 samples must be subjected to measurement.

The tabular silver halide grains have an average thickness of 0.5 μm or less, preferably, 0.35 μm or less.

In the present invention, an edge length of the major face of the tabular grain is defined as an edge length of a square having an area equivalent to the projcted area of the tabular grain, based on the electronmicrographic observation.

In the present invention, a thickness of the grain is defined as a distance between two parallel faces largest among faces constituting the tabular grain. The thickness of the tabular grain is therefore to be a distance between two major faces.

The thickness of the tabular grain can be determined from an electronmicrograph with shadowgraph of the grain or a sectional electronmicrograph of a sample comprising a support coated thereon with a silver halide emulsion.

In the invention, the tabular grains account for 50% or more, preferably, 60% or more, and more preferably, 70% or more of the projected area of total grains contained.

The tabular grains of the invention may comprise, besides {100} face, other crystal faces such as {111} and {110} faces.

The tabular silver halide grains are preferably monodisperse and more preferably, a coefficient of variation of the edge length of the major face is within a range of 20% or less. The tabular grain emulsion of the invention may be blended with a monodispersed tabular grain emulsion having a different edge length of the major face or polydispersed tabular grain emulsion. The tabular grain emulsion of the invention may be blended with monodispersed or polydispersed non-tabular grain emulsion.

The coefficient of variation is shown as a value of a standard deviation of a grain size (corresponding to an edge length of an square equivalent to the area of the major face) divided by an average grain size times 100 (%).

In a silver halide photographic light sensitive material of the invention, 40% or more (preferably 50% or more and more preferably 60 mol % or more) of a silver halide emulsion contained a silver halide emulsion layer is accounted for by a silver halide emulsion of the invention, which comprises selenium-sensitized grains having a silver chloride content of 50 mol % or more and in which a relative standard deviation of a silver iodide content of the grain is 30% or less.

A solid solution limit (solid solubility) of silver iodide contained in silver chloride was shown to be 13 mol % according to H. Hirsch, Journal of Photographic Science, Vol. 10, pages 129–139 (1962). A silver halide tabular grain emulsion used in the invention is silver iodochloride or iodobromochloride containing 50 mol % or more silver chloride, preferably, silver iodochloride or silver iodobromochloride containing 70 mol % or more silver chloride. An average silver iodide content is 0.01 to 13.0 mol %, preferably, 0.05 to 8.0 mol % and more preferably, 0.1 to 3.0 mol %.

Tabular silver halide grains of the invention may contain internally a plane defect such as a twin plane. The tabular grains may comprise homogeneous halide composition or core/shell structure containing iodide internally localized. The tabular grains may have a high silver iodide content in the vicinity of the surface thereof.

A preparation method of the tabular silver halide grains of the invention may be referred to U.S. Pat. Nos. 4,063,951, 4,386,156, 5,275,930 and 5,314,798.

The size and form of the tabular silver halide grains of the invention can be controlled by adjusting a temperature, pAg, pCl, pBr, pH and flowing rates of silver salt and halide solutions during the course of forming the grains. The pCl is adjusted to be within a range of 0.5 to 4.0, preferably, 1.0 to 3.5, more preferably, 1.5 to 3.0 during the course of from nucleation to growth of the tabular grains of the invention. Further therto, the pH is adjusted to be within a range of 2.0 to 8.0, preferably, 5.0 to 7.0.

The halide composition of the tabular silver halide grains can be controlled by varying halide composition (proportion of chloride, bromide and iodide) of a dispersing medium and/or a halide solution to be added.

In the present invention, a variation coefficient (alternatively, relative standard deviation) of a silver iodide content of the grains is 30% or less, preferably, 20% or less and more preferably, 15% or less. The silver iodide content of the grain can be determined by analyzing each of grains with respect to the halide composion, for example, using a X-ray micro-analyzer. The variation coefficient of a silver iodide content of the grains refers to a value of a standard deviation of the silver iodide content of the grains (S) divided by an average silver iodide content of the grains (I) and further multiplied by 100% (thus, expressed as S/I x-100%).

In order to determine the silver iodide content of the grains, at least 100 grains are subjected to the measurement thereof using a X-ray micro-analyzer. A method for measuring the silver iodide content of the grain is exemplarily explained as follows. First, an emulsion sample is diluted five times with distilled water and then protenaise is added, thereafter, the emulsion is maintained at 40° C. for 3 hrs. to decompose gelatin. The sample is subjected to centrifugation to cause emulsion grains to be sedimented. After decantation, distilled water is added to disperse the grains. This washing procedure is repeated twice and then the sample is dispersed over a sample plate. After drying, the sample is exposed to carbon vacuum evaporation and then subjected to measurement with a X-ray microanalyzer, which is commercially available. In the present invention was empolyed a X-ray microanalyzer EMX-SM produced by Shimazu Seisakusho. In the measurement, silver halide grains each exposed to electron beam and characteristic X-ray intensities of constituent elements of the grain which have been excited by the electron beam are measured by a wavelength-dispersion type X-ray detector. To determine the silver iodide content of the grain from the characteristic X-ray intensity of each element, the measurement is conducted in a similar manner with respect to grains, of which silver iodide content has already known, to prepare a calibration curve. The silver iodide content can be determined from the calibration curve.

To make a relative standard deviation of the silver iodide content of the grain 30% or less, it is preferable to supply a silver iodide fine grain emulsion, as a source of silver iodide to be contained in the grain, in the course of forming the grains. The average grain size of silver iodide fine grains is 0.1 μm or less, preferably, 0.07 μm or less and more preferably, 0.05 μm or less.

With respect to silver iodide, there is generally known cubic γ-AgI and hexagonal β-AgI and any of them can be used as silver iodide fine grains singly or in combination thereof. It is preferable to use monodispersed silver iodide fine grain emulsion, which can be prepared by controlling a temperature, pH and pAg in a double jet method.

In the preparation of the inventive emulsion, the silver iodide fine grain emulsion may be previously added into a dispersing medium. However, it is preferable to add a silver iodide fine grain emulsiona along with silver nitrate aqueous solution and a halide aqueous solution by a triple jet method to obtain an objective halide composition finally, while controlling flowing rates, the pCl (pAg), pH and temperature.

A high degree of super-saturation of a mixture solution is preferable during the addition and it is preferable to add acceleratedly solutions, as described in U.S. Pat. No. 4,242,445, in such a manner that a growing rate of silver halide crystals becomes 30 to 100% of the critical growing rate thereof. There can be obtained an inventive emulsion having a narrow iodide content distribution by adding the solutions in such a manner as above-described, while keeping the pCl within a range of 0.5 to 3.5.

In the preparation of the tabular silver halide grains, are optionally employed a silver halide solvent such as ammonia, thioether or thiourea.

The emulsion above-described may be any of surface latent image forming type, internal latent image forming type, and surface-and-internal latent image forming type. In these emulsions, an iron salt, cadmium salt, lead salt, zinc salt, thallium salt, ruthenium salt, osmium, iridium salt or complex thereof, or rhodium salt or complex thereof may be added into these emulsion during the course of forming and physical ripening of grains.

The emulsion may be subjected to washing such as ultrafiltration, noodle washing or flocculation precipitation to remove soluble salts. As preferable example thereof are cited the use of an aromatic hydrocarbon type aldehyde resin containing a sulfo group as disclosed in Japanese Patent examined No. 35-16086/1960 and the use of polymeric flocculant, G3 and G8 exemplified in JP-A 63-158644/1988.

Accoding to the invention, a silver halide emulsion is selenium-sensitized with a selenium compound. The senium-sensitization can be conducted in a manner known in the art. Thus, a labile selenium compound and/or non-labile selenium compound is added to the emulsion, which is further maitained at a high temperature for a period of time with stirring. There is preferably employed a selenium sensitization with a labile selenium compound as disclosed in Japanese Patent examined No. 44-15748/1969. As examples of labile selenium sensitizers are cited an aliphatic isoselenocyanate, selenourea, selenoketone, selenoamide, selenocarboxylic acid and estrer thereof, and selenophosphate. Preferable examples thereof are shown as below.

(1) colloidal elemental selenium (2) organic selenium compound (in which a selenium atom is covalently double-bonded to a carbon atom of an organic compound)

a) Isoselenocyanate e.g., aliphatic isoselenocyanate such as allyl isocyanoselenate b) Selenourea including enol type e.g., selenourea, aliphatic selenourea such as methyl-, ethyl-, propyl-, isopropyl-, butyl-, hexyl-, octyl-, dioctyl-, tetramethyl-, n-(β-carboxyethyl)-N,N'-dimethyl-, N,N-dimethyl-diethyl, or dimethylselenourea; aromatic selenourea containing one or more aromatic groups such as phenyl or tolyl; heterocyclic selenourea containing a heterocyclic group such as pyridyl or benzothiazolyl. As prefrable selenoureas are cited N,N-substituted selenourea such as an aliphatic selenourea including N,N-dimethylselenourea and N,N-diethylselenourea, and phenyl or pyridyl-substituted selenourea.

c) selenoketone e.g., selenoacetone, selenoacetophenone, selenoketone in which an alkyl group is bonded to =C=Se, and selenobenzophenone.

d) selenoamide e.g., selenoamide e) selenocarboxylic acid and ester thereof e.g., 2-selenopropionic acid, 2-selenobutyric acid and methy-3-selenobutyrate (3) Others a) Selenide e.g., dimethylselenide, diethylselenide and triphenylphophineselenide b) Selenophosphate e.g., tri-p-triselenophosphate and tri-n-butylselenophosphate Labile selenium compounds are not limited to the above-described compounds.

A non-labile selenium compound ia also usable as a selenium sensitizer, as disclosed in Japanese Patent examined Nos. 46-4553/1971, 52-34491/1977 and 52-34492/1977. As examples thereof are cited selenious acid, potassium selenocyanate, selenazoles and quaternary ammonium salt thereof, diarylselenide, diaryldiselenide, 2-thioselenazolidinedione, 2-selenooxazolidinedione and derivative thereof.

A non-labile selenium sensitizer, thioselenazolidine-dione compound as disclosed in Japanese Patent examined 52-38408/1977 is also effective.

The addition amount of the selenium sensitizer is optional, depending on conditions such as the pH, temperature and silver halide grain size. It is preferably $1\times10^{-8}$ to $1\times10^{-2}$ and more preferably, $1\times10^{-7}$ to $1\times10^{-4}$ mol per mol of silver halide.

Exemplary examples of selenium compounds are shown as below.

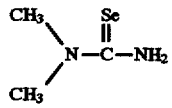
Se-1

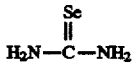
Se-2

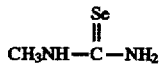
Se-3

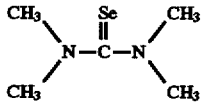
Se-4

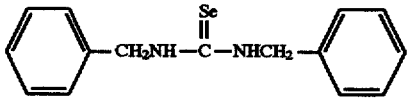
Se-5

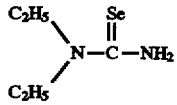
Se-6

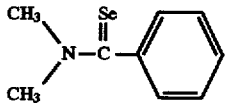
Se-7

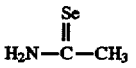
Se-8

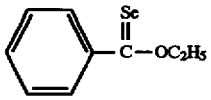
Se-9

-continued

Se-10

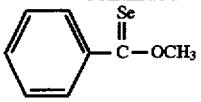

Se-11

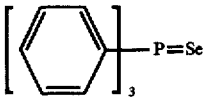

Se-12

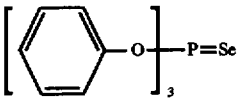

Se-13

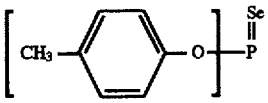

Se-14

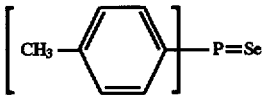

Se-15

$(nC_4H_9O)_3-P=Se$

Se-16

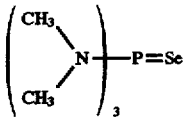

According to the invention, the selenium sensitization is carried out preferably in the presence of a purine compound. As a purine compound are cited xanthine, 7-azaindole, adenine and 4,5,6-triaminopyridine. Another purine compound is represented by the following formula.

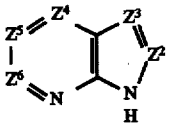

In the formula, $Z^2$ represents —C($R^2$)= or —N=; $Z^3$ represents —C($R^3$)= or —N=; $Z^4$ represents —C($R^3$)= or —N=; $Z^5$ represents —C($R^5$)= or —N=, provided that only one of $Z^4$, $Z^5$ and $Z^6$ is —N=; $R^3$ and $R^5$ independently represent a hydrogen atom, hydroxy group, halogen atom, amino group or hydrocarbon group having 1 to 7 carbon atoms, $R^4$ represents a hydrogen atom, halogen atom or a hydrocarbon group having 1 to 7 carbon atoms, and $R^6$ is a hydrogen atom or —$NH_2$.

Further, another purine type heterocyclic compound is represented by the following formula.

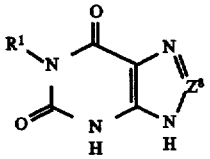

In the formula, $Z_8$ represents —C($R^8$)= or —N=; $R^8$ represents a hydrogen atom, —$NH^2$ or —$CH_3$ and $R^1$ a hydrogen atom or hydrocarbon group having 1 to 7 carbon atoms.

Furthermore, another purine type compound is a 2-hydroaminoazine represented by the following formula

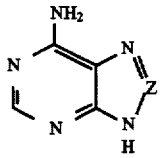

In the formula, Z is the same as defined in $Z^8$.

The addition amount of the purine compound described above is preferably 0.05 to 500, more preferably, 0.5 to 50 mg per mol of silver halide. Examples of purine compounds are shown as below.

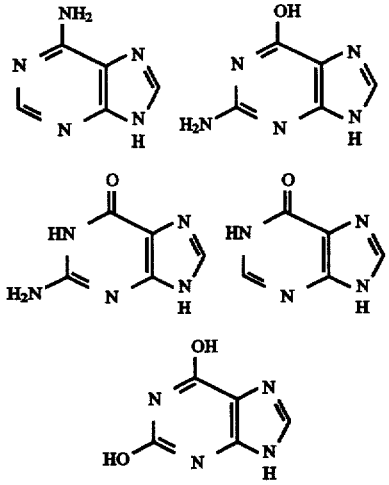

According to the invention, it is preferable that a silver halide emulsion is selenium-sensitized in combination with another sensitizing method. Particularly, a combination of sulfur and gold sensitization with the selenium sensitization not only enhances sensitizing effect but also achieves effectively fog-prevention.

Sulfur sensitizers include, for example, a thiosulfate, allylthiocarbamide, thiourea, allylisothiocyanate, cystine, p-toluenethiosulfate and rhodanine. Further, there can be employed sulfur sensitizers as described in U.S. Pat. Nos. 1,574,944 and 3,656,955, German patent No. 1,422,869, Japanese Patent examined 56-24937/1981 and JP-A 55-45016/1980. The sulfur sensitizer is added in an amount enough to enhance effectively sensitivity of a silver halide emulsion. The addition amount is variable, depending on conditions such as the pH, temperature and silver halide grain size, however, it is preferably $5\times10^{-7}$ to $5\times10^{-3}$ and more preferably, $2\times10^{-6}$ to $4\times10^{-4}$ mol per mol of silver halide.

Gold sensitizers include a chloroaurate, gold-thiourea complex salt, potassium chloroaurate, auric trichloride, potassium auric thiocyanate, potassium iodoaurate, tetracyanoauricamide, ammonium aurothiocyanate and pyridyltrichlorogold. The addition amount thereof is variable, depending on conditions such as the pH, temperature and silver halide grain size, however, it is preferably $5\times10^{\Delta7}$ to $5\times10^{-3}$ and more preferably, $2\times10^{-6}$ to $4\times10^{-4}$ mol per mol of silver halide.

There may be applicable reduction sensitization or hydrogen sensitization in the invention. As a reduction sensitizer, are available a stannous salt, amine, formaminedisufinic acid, silane, borane, and ascorbic acid and derivative thereof.

The addition amount of the reuction sensitizer, depending on reducibility thereof, the kind of silver halide and dissolving condition, is $1\times10^{-8}$ to $1\times10^{-2}$ mol per mol of silver halide.

The temperature for chemical sensitization (or chemical ripening) of a silver halide emulsion relating to the invention can be optionally selected and is preferably 30° to 90° C., more preferably, 35° to 70° C.

Considering the emulsion stability, it is preferable to employ a chemical ripening-stopping agent to stop the chemical sensitization. As a chemical ripening-stopping agent, there has been known a halide (e.g., potasium bromide and sodium chloride), antifoggant or stabilizer (e.g., 4-hydroxy-6-methyl-1,3,3a,7-tetraazaindene). These compound can be employed singly or in combination thereof.

In the preparation of a silver halide emulsion, it is advantageous to employ geltin as a protevtive colloid used in a dispsion medium or a binder of a hydrophilic colloidal layer; however, another hydrophilic colloid may be advantageously usable.

As examples thereof are cited a gelatin derivative, graft polymer of gelatin and another polymer, protein such as albumin or casein, cellulose derivative such as hydroxyethyl cellulose, carboxymethyl cellulose or cellulose sulfuric acid ester, sodium alginate, saccharide derivative such as a starch derivative, polymer such as polyvinyl alcohol and partial acetal thereof, poly-N-vinyl pyrrolidone polyacrylic acid, polymethaacrylic acid, polyacrylamide, polyvinyl imidazole or polyvinyl pyrazole, and copolymer thereof.

As gelatin is usable lime-treated gelatin, acid-treated gelatin, enzyme-treated gelatin described in Bull. Soc. Sci. Phot. Japan, No. 16, page 30 (1966), or hydrolysis product or enzymatic process product from gelatin. In the preparation of a silver halide emulsion of the invention, it is advantageous to employ a gelatin having a low methionine content of less than 30 μmol per g of gelatin, preferably, less than 12 μmol per g of gelatin, as disclosed in U.S. Pat. No. 4,713,323.

To a silver halide emulsion used in the photographic material of the invention are added various kinds of photographic additives at a time before, during or after physical ripening or chemical ripening. As the additives, can be employed compounds as described in afore-mentioned RD Nos. 17643, 18716 and 308119, wherein relevant types of compounds and sections thereof are follows.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IV |
| Desensitizing dye | 23 | IV | | 998 | B |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Antistatic agent | 27 | XII | 650 right | 1006–7 | XIII |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

As supports used in the photographic material of the invention are cited those described in afore-mentioned RD-17643, page 28 and RD-308119, page 1009.

As an optimal support is cited polyethylene terephthalate film. The surface of the support may be sub-coated or exposed to corona discharge or UV-ray.

EXAMPLES

Embodiments of the present invention will be explained as below, but the present invention is not limited thereto.

Example 1

A silver halide tabular grain emulsion, EM-1 was prepared using the following solutions.

| Preparation of EM-1: | |
|---|---|
| Solution $A_1$ | |
| Oxidation-treated gelatin | 350 g |
| Sodium chloride | 3.27 g |
| Potassium iodide | 0.25 g |
| Water to make | 10.0 l |
| Solution $B_1$ | |
| Silver nitrate | 25.5 g |
| Water to make | 150 ml |
| Solution $C_1$ | |
| Sodium chloride | 8.72 g |
| Water to make | 150 ml |
| Solution $D_1$ | |
| Potassium iodide | 0.52 g |
| Water to make | 150 ml |
| Solution $E_1$ | |
| Silver nitrate | 794.5 g |
| Water to make | 9.4 l |
| Solution $F_1$ | |
| Sodium chloride | 286.4 g |
| Water to make | 10.0 l |

To solution $A_1$ in a reaction vessel, solutions $B_1$, $C_1$ and $D_1$ were simultaneously added by triple jet method for 30 sec., while being kept at 40° C. with high-speed stirring. After the rection mixture was maintained at 40° C. for 12 min. with stirring, solutions E1 and F1 were added thereto at a flowing rate of 40 ml/min. for 40 min. by a double jet method and further added at a flowing rate of 80 ml/min. for 100 min. During the addition, the pCl was controlled to be 2.25, while the pH was maintained at 5.8. Thereafter, 100 g of phthalated gelatin was added to the resulting emulsion, which was then subjected to coagulation desalting to remove soluble salts using an aqueous solution of Demol (product of Kao-Atlas Corp.) and aqueous magnesium sulfate solution. Further, additional gelatin was added to the emulsion, which was maintained at 50° C. for 30 min. with stirring and then cooled down to be set.

From electronmicrograph of the thus prepared silver iodochloride emulsion containing a silver iodide content of 0.2 mol %, it was proved that 85% of total grains was accounted for by tabular grains having square-formed major faces, an average edge length (average grain size) of 1.33 μm, variation coefficient of grain size of 27%, an average thickness of 0.17 μm and average aspect ratio of 7.8. This emulsion was referred to EM-1.

Preparation of EM-2:

A silver iodochloride emulsion EM-2 (silver iodide content of 0.2 mol %) was prepared in the same manner as EM-1, except that the pCl was kept at 2.05 during the addition of solutions of $F_1$ and $F_1$. From the observation by electronmicroscope, it was proved that 93% of emulsion grains was accounted by tabular grains having square-formed major faces, an average grain size of 1.3 μm, an average thickness of 0.18 μm and average aspect ratio of 7.3. This emulsion was referred to EM-2.

Preparation of silver iodide fine grain emulsion:

To 5000 ml of a 5.2 wt. % gelatin aqueous solution containing 0.008 mol of potassium iodide, 1500 ml of an aqueous solution containing 1.06 mol of silver nitrate and 1500 ml of an aqueous solution containing 1.06 mol of potassium iodide were each added over a period of 30 min., while being kept at 40° C. From the 60,000 times-enlarged electronmicrograph of silver iodide fine grains prepared, it was proved that the average grain size was 0.045 μm.

Preparation of EM-3:

A silver iodochloride emulsion EM-3 (silver iodide content of 0.2 mol %) was prepared in the same manner as EM-1, except that solution D1 was replaced by a solution containing a silver iodide fine grain emulsion equivalent to $3.13\times10^{-3}$ mol. From the observation by electronmicroscope, it was proved that 88% of emulsion grains was accounted by tabular grains having square-formed major faces, an average grain size of 1.29 μm, an average thickness of 0.18 μm and averae aspect ratio of 7.2.

Preparation of EM-4:

A silver iodochloride emulsion EM-4 (silver iodide content of 0.2 mol %) was prepared in the same manner as EM-3, except that the pCl was kept at 2.05 during the addition of solutions of E1 and F1. From the observation by electronmicroscope, it was proved that an average grain size, average thickness and average aspect ratio were respectively 1.2 μm, an average thickness of 0.21 μm and averae aspect ratio of 5.7.

| Preparation of EM-5: | |
|---|---|
| Solution $A_2$ | |
| Oxidation-treated gelatin | 350 g |
| Sodium chloride | 3.27 g |
| Water to make | 10.0 l |
| Solution $B_2$ | |
| Silver nitrate | 25.5 g |
| Water to make | 150 ml |
| Solution $C_2$ | |
| Sodium chloride | 8.72 g |
| Water to make | 150 ml |
| Solution $D_2$ | |
| silver iodide fine grain emulsion | $3.13\times10^{-3}$ mol. eq. |
| Water to make | 150 ml |
| Solution $E_2$ | |
| Silver nitrate | 794.5 g |
| Water to make | 9.4 l |
| Solution $F_2$ | |
| Sodium chloride | 286.4 g |
| Water to make | 10.0 l |

To solution $A_2$ in a reaction vessel, was added a silver iodide fine grain emulsion of $1.51\times10^{-3}$ mol. equivalent and then solutions $B_2$, $C_2$ and $D_2$ were simultaneously added by triple jet method for 30 sec., while being kept at 40° C. with high-speed stirring. After the rection mixture was maintained at 40° C. for 12 min. with stirring, solutions $E_2$ and $F_2$ were added thereto at a flowing rate of 40 ml/min. for 40 min. by a double jet method and further added at a flowing rate of 80 ml/min. for 100 min. During the addition, the pCl was controlled to be 2.25, while the pH was maintained at 5.8. Thereafter, 100 g of phthalated gelatin was added to the resulting emulsion, which was then subjected to coagulation desalting to remove soluble salts. Further, additional gelatin was added to the emulsion, which was maintained at 50° C. for 30 min. with stirring and then cooled down to be set.

From the electronmicrscopic observation of the thus prepared silver iodochloride emulsion, it was proved that 94% of total grains was accounted for by tabular grains having square-formed major faces, an average edge length (average grain size) of 1.07 μm, variation coefficient of grain size of 27%, an average thickness of 0.29 μm and averae aspect ratio of 3.7. This silver iodochloride emulsion containing a silver iodide content of 0.2 mol % was referred to EM-5.

Preparation of EM-6:

A silver iodochloride emulsion EM-6 (containing a silver iodide content of 0.2 mol %) was prepared in the same manner as EM-5, except that the pCl was kept at 2.05 during the addition of solutions $E_2$ and $F_2$. From electronmicroscopic observation, the average grain size, thickness and aspect ratio were respectively 0.98 mm, 0.32 μm and 3.1.

Chemical sensitization of emulsions:

To the each of the emulsions thus-prepared was added an aqueous solution of the following compound (a) in an amount as shown in Table 1, while being kept at 50° C. with stirring. After 20 min., ammonium thiocyanate, chloroauric acid, sodium thiosulfate, and selenium sensitizers, compounds (b) and (c) were added thereto in an amount of 52 mg, 0.5 mg, 1.7 mg, 0.04 mg and 0.05 mg, respectively. After further being kept at 50 kC for 40 to 100 min., 4-hydroxy-6-methyl-1,3,3a,7-tetraazaindene and 1-phenyl-5-mercaptotetrazole were added to stabilize the emulsion. Thus, each of the emulsions was optimally chemically sensitized.

Compound (a)

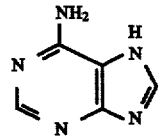

Compound (b)

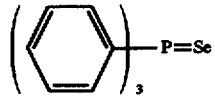

Compound (c)

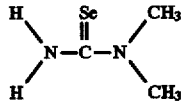

To each of the resulting emulsions was added additives described as below to prepare an emulsion coating solution. At the same time, a protective layer coating solution was also prepared. Simultaneous double side coating was conducted at a coating speed of 80 m/min. using a slide hopper type coater so that silver and gelatin coating amount were 2.8 and 3.6 g/m², respectively. After coating, drying was conducted for 2 min.20 sec.to obtain a photographic material samples as shown in Table 1. As a support was employed 175 μm polyethylene terephthalate film base for X-ray use, having a blue density of 0.15 and sub-coated with a copolymer of glycidylmethaacrylate (50 wt. %), methylmethaacrylate (10 wt. %) and butylmethaacrylate (40 wt. %).

The following additives were used for the emulsion. the adding amount is expressed in an amount per mol of silver halide.

| | |
|---|---|
| 1,1-Dimethylol-1-brom-1-nitromethane | 70 mg |
| t-Butyl-catechol | 82 mg |
| Polyvinyl pyrrolidone (M.W.,10,000) | 1.0 g |
| Stylene-anhydrous maleic acid copolymer | 25 g |
| nitrophenyl-triphenylphosphonium chloride | 50 mg |
| Ammonium 1,3-dihydroxybenzene-4-sulfonate | 2.0 g |

-continued

| | |
|---|---|
| Sodium 2-mercaptobenzimidazole-5-sulfonate | 1.5 mg |
| 2-Mercapto-(S-acetyl)succinic acid anhydride | 7.2 mg |
| 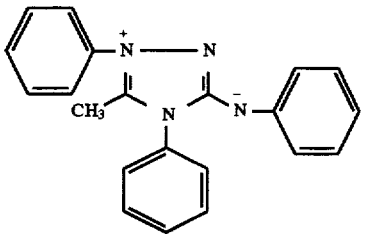 | 150 mg |
| 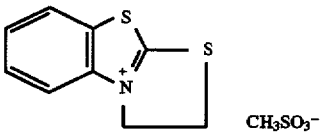 | 80 mg |
| $C_4H_9OCH_2CH(OH)CH_2N(CH_2COOH)_2$ | 1 g |
| 1-Phenyl-5-mercaptotetrazole | 15 mg |
| Diethylene glycol | 7 g |
| Dextran (M.W., 60,000) | 600 mg |
| Sodium polyacrylate (M.W., 36,000) | 2.5 g |

The protective layer coating solution was prepared as follows. The adding amount was expressed in an amount per liter of the coating solution.

| | |
|---|---|
| Lime-treated gelatin | 68 g |
| Acid-treated gelatin | 2 g |
| Sodium i-amyl-n-decylsulfosuccinate | 0.3 g |
| Polymethylmethaacrylate (matting agent, area-averaged particl size of 1.2 μM) | 1.1 g |
| Silicon dioxide (matting agent, area-averaged particle size of 1.2 μm) | 0.5 g |
| Ludox AM, product of Du pont (matting agent) | 30 mg |
| $(CH_2{=}CHSO_2CH_2)_2O$ (hardener) | 7 mg |
| 40% Glyoxal aqueous solution (hardener) | 2 mg |
| 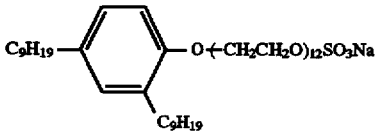 | 1.0 g |

-continued

| | |
|---|---|
| 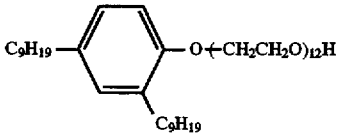 | 0.4 g |
| 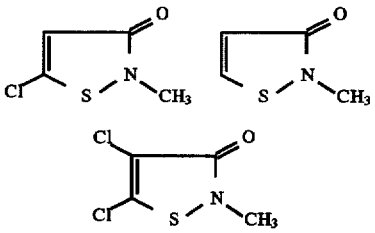 (50:46:4) | 0.1 g |

Sensitometry (Evaluation of phtographic characteristics)

A photographic material sample was laminated with two intensifying screen sheets (NR-160, product of Konica Corp.) and exposed, through an aluminium wedge, to X-ray emitted at 80 kvp of bulb voltage and 50 mA of bulb current for 0.05 sec. Exposed samples were precessed with a developer and fixer SR-DF (product of Konica Corp.) using a roller transport type automatic processor.

The processing time was 45 sec. in dry to dry. The temperature of developing, fixing, washing and drying were 35°, 33°, 20° and 50° C., respectively. A sensitivity was expressed as reciprocal of an exposing amount necessary for giving a density of fog plus 1.0. The sensitivity was shown as a relative value, based on the sensitivity of Sample 1 aged at 23° C. and 55% RH for 1 day being 100.

Evaluation of abrasion resistance:

After being aged at 25° C. and 30% RH for 1 hr., an unexposed photographic material sample was scrubbed with a nylon-made brush at a speed of 2 cm/min. with loading 100 g on the area of 2 $cm^2$. After being processed by a automatic processor as above-described, the number of the abrasion mark was counted.

Results thereof are shown in Table 1.

TABLE 1

| | Emulsion | | | | | | | | |
|---|---|---|---|---|---|---|---|---|---|
| Sample No. | EM-No. | V.C. (%)* | Aspect ratio | Compd. (a)** | Selenium sensitizer | Fog | Sensitivity | No. of abrasion | Remarks |
| 1 | 1 | 43 | 7.8 | None | (b) | 0.07 | 100 | 53 | Comp. |
| 2 | 2 | 40 | 7.3 | None | (b) | 0.07 | 100 | 56 | Comp. |
| 3 | 3 | 26 | 7.2 | None | (b) | 0.05 | 120 | 22 | Inv. |
| 4 | 4 | 24 | 5.7 | None | (b) | 0.05 | 121 | 18 | Inv. |
| 5 | 5 | 21 | 3.7 | None | (b) | 0.05 | 126 | 15 | Inv. |
| 6 | 6 | 20 | 3.1 | None | (b) | 0.05 | 125 | 18 | Inv. |
| 7 | 1 | 43 | 7.8 | 2 mg | (b) | 0.07 | 109 | 50 | Comp. |
| 8 | 2 | 40 | 7.3 | 2 mg | (b) | 0.07 | 109 | 53 | Comp. |
| 9 | 3 | 26 | 7.2 | 2 mg | (b) | 0.04 | 130 | 15 | Inv. |
| 10 | 4 | 24 | 5.7 | 2 mg | (b) | 0.03 | 135 | 14 | Inv. |
| 11 | 5 | 21 | 3.7 | 2 mg | (b) | 0.03 | 139 | 11 | Inv. |
| 12 | 6 | 20 | 3.1 | 2 mg | (b) | 0.03 | 140 | 12 | Inv. |
| 13 | 1 | 43 | 7.8 | 10 mg | (b) | 0.07 | 105 | 50 | Comp. |
| 14 | 2 | 40 | 7.3 | 10 mg | (b) | 0.07 | 107 | 47 | Comp. |
| 15 | 3 | 26 | 7.2 | 10 mg | (b) | 0.03 | 138 | 13 | Inv. |
| 16 | 4 | 24 | 5.7 | 10 mg | (b) | 0.03 | 140 | 10 | Inv. |

TABLE 1-continued

| Sample No. | Emulsion EM-No. | V.C. (%)* | Aspect ratio | Compd. (a)** | Selenium sensitizer | Fog | Sensitivity | No. of abrasion | Remarks |
|---|---|---|---|---|---|---|---|---|---|
| 17 | 5 | 21 | 3.7 | 10 mg | (b) | 0.03 | 150 | 12 | Inv. |
| 18 | 6 | 20 | 3.1 | 10 mg | (b) | 0.03 | 150 | 9 | Inv. |
| 19 | 1 | 43 | 7.8 | 12 mg | (c) | 0.09 | 92 | 67 | Comp. |
| 20 | 2 | 40 | 7.3 | 12 mg | (c) | 0.10 | 93 | 72 | Comp. |
| 21 | 3 | 26 | 7.2 | 12 mg | (c) | 0.05 | 125 | 20 | Inv. |
| 22 | 4 | 24 | 5.7 | 12 mg | (c) | 0.04 | 130 | 18 | Inv. |
| 23 | 5 | 21 | 3.7 | 12 mg | (c) | 0.04 | 136 | 14 | Inv. |
| 24 | 6 | 20 | 3.1 | 12 mg | (c) | 0.04 | 136 | 15 | Inv. |

*Variation coefficient of a silver iodide content of grains
**mg per mol of silver halide As can be seen from Table 1, it was proved that inventive samples exhibited higher sensitivity and improved abrasion-resistance resistance with less abrasion marks, even when subjected to rapid processing.

What is claimed is:

1. A silver halide black and white photographic light sensitive material comprising a support having thereon a silver halide emulsion layer containing silver halide grains, which are tabular grains having two parallel major faces comprised of {100} faces and an average silver chloride content of 50 mol % or more and have been selenium-sensitized in the presence of a purine compound; said silver halide grains further containing silver iodide and a variation coefficient of a silver iodide content of the grains being 30% or less.

2. The photographic material of claim 1, wherein said tabular grains have an average grain size of 0.3 to 3.0 μm and an average aspect ratio of 2.0 or more.

3. The photographic material of claim 1, wherein said tabular grains account for 50% or more of the projected area of the total silver halide grains contained in the silver halide emulsion.

4. A silver halide black and white photographic light sensitive material comprising a support having thereon a silver halide emulsion layer containing silver halide grains which are tabular grains having two major {100} faces parallel to each other and a silver chloride content of 50 mol % or more; said silver halide grains further containing silver iodide and a relative standard deviation of a silver iodide content of the grain being 30% or less; and said silver halide emulsion being prepared by a process comprising:

(i) forming the silver halide emulsion by mixing a silver salt and a halide salt in a dispersing medium and (ii) subjecting the emulsion formed to chemical sensitization, wherein in step (ii), said silver halide emulsion is selenium-sensitized by adding a selenium compound and in the presence of a purine compound.

5. The photographic material of claim 6, wherein said tabular grains have an average grain size of 0.3 to 3.0 μm and an average aspect ratio of 2.0 or more.

6. The photographic material of claim 4, wherein said selenium compound is selected from an elemental selenium, an isoselenocyanate, a selenourea, a selenoketone, a selenoamide, a selenocarboxylic acid and an ester thereof, a selenide and a selenophosphate.

7. The photographic material of claim 4, wherein silver iodide fine grains having an average grain size of 0.1 μm or less are supplied as a source of silver iodide at a time during the course of forming the silver halide emulsion.

8. The photographic material of claim 4, wherein said silver halide grains are silver iodochloride or silver iodobromochloride.

* * * * *

UNITED STATES PATENT AND TRADEMARK OFFICE

CERTIFICATE OF CORRECTION

PATENT NO. : 5,800,975
DATED : September 1,1998
INVENTOR(S) : SUZUKI

It is certified that error appears in the above-indentified patent and that said Letters Patent is hereby corrected as shown below:

Claim 5, column 16, line 28, "claim 6 " should read --claim 4--.

Signed and Sealed this

Twenty-first Day of September, 1999

*Attest:*

Q. TODD DICKINSON

*Attesting Officer*

*Acting Commissioner of Patents and Trademarks*